US005954112A

United States Patent [19]

Forbes Jones et al.

[11] Patent Number: 5,954,112

[45] Date of Patent: Sep. 21, 1999

[54] MANUFACTURING OF LARGE DIAMETER SPRAY FORMED COMPONENTS USING SUPPLEMENTAL HEATING

[75] Inventors: Robin M. Forbes Jones, Charlotte; Richard L. Kennedy, Monroe, both of N.C.

[73] Assignee: Teledyne Industries, Inc., Los Angeles, Calif.

[21] Appl. No.: 08/999,594

[22] Filed: Jan. 27, 1998

[51] Int. Cl.[6] ..... B22D 23/00

[52] U.S. Cl. ..... 164/46; 164/271

[58] Field of Search ..... 164/46, 271, 457

[56] References Cited

U.S. PATENT DOCUMENTS

| | | | |
|---|---|---|---|
| 3,963,812 | 6/1976 | Schlienger | 264/8 |
| 4,264,641 | 4/1981 | Mahoney | 427/30 |
| 4,626,278 | 12/1986 | Kenney | 75/0.5 C |
| 4,723,994 | 2/1988 | Ovshinsky | 75/0.5 C |
| 4,938,275 | 7/1990 | Leatham | 164/46 |
| 5,054,539 | 10/1991 | Keutgen | 164/457 |
| 5,143,139 | 9/1992 | Leatham | 164/46 |
| 5,147,448 | 9/1992 | Roberts | 75/331 |
| 5,266,098 | 11/1993 | Chun | 75/335 |
| 5,272,718 | 12/1993 | Stenzel | 373/22 |
| 5,305,816 | 4/1994 | Ikawa | 164/46 |
| 5,343,926 | 9/1994 | Cheskis | 164/46 |
| 5,472,038 | 12/1995 | Forrest et al. . | |
| 5,520,715 | 5/1996 | Oeftering | 75/335 |

FOREIGN PATENT DOCUMENTS 5-161956 6/1993 Japan .

*Primary Examiner*—Patrick Ryan
*Assistant Examiner*—I.-H. Lin
*Attorney, Agent, or Firm*—Robert J. Pugh; Patrick J. Viccaro

[57] ABSTRACT

A process for manufacturing large diameter, spray formed billets, rings, or tubular forms by spraying atomized molten metal onto a rotating surface. The rotating surface has a collector surface that is maintained at a predetermined temperature or reheated to the predetermined temperature by an external heat source. The external heat source impinges upon the collector surface to form a reheated or preheated zone. The external heat may be provided by a laser, high temperature flame, plasma arc, electric induction or radiation source. The molten metal is sprayed onto the collector surface in the reheated or preheated zone. Apparatus for carrying out the process is also disclosed.

14 Claims, 2 Drawing Sheets

MANUFACTURING OF LARGE DIAMETER SPRAY FORMED COMPONENTS USING SUPPLEMENTAL HEATING

FIELD OF THE INVENTION

The present invention relates generally to spray forming large diameter metal preforms (billets, rings, and tubular formations) using nickel base alloys or steels. More particularly, it relates to methods and means by which large diameter preforms of highly reactive molten metal alloys can be manufactured using spray forming. While the process is described in terms of high melting point nickel base alloys, it is broadly applicable to any metallic preform, such as those made from Al, Ti, Cu, etc.

BACKGROUND OF THE INVENTION

In the more familiar technique for producing semi-finished nickel-based alloy components, particularly those used for critical applications, such as rotating disks for jet engines, the raw materials are melted in a vacuum induction furnace of 20,000 to 35,000 pounds or more. The raw materials can include virgin metal and scrap to achieve the nominal alloy composition and to reduce the overall cost of the process. A large ingot is formed from the melting process. This ingot usually contains defects of at least three types; voids, macrosegregation and inclusions. Subsequent processing is generally used to eliminate or minimize the defects caused by the previous processing. For example, electroslag refining is commonly used to remove the oxide and sulfide and slag inclusions. This process is described in detail on pages 82–84 of a text on metal refining entitled "*Superalloys, Super composites and Superceramics*" edited by John K. Tien and Thomas Caulfield and published by Academic Press. The product of electroslag refining has significantly lower concentrations of oxides and sulfides than the product from the vacuum induction melting process. It is also largely free of voids and slag inclusions.

A problem arises in electroslag refining of large diameter ingots because of the formation of a relatively deep melt pool during processing. The deep pool results in excessive macrosegregation and microsegregation, manifest as "freckles", and in less desirable microstructures.

One way to overcome this deep pool problem is to reduce the diameter of the ingot being processed, but this adversely affects the economics of the process and limits the maximum product size. Another way is to incorporate a subsequent melting step in combination with the electroslag refining. The subsequent melting step is vacuum arc remelting, and is a well known process, known to produce a relatively shallow melt pool and to produce a better microstructure. Thus, for any given alloy, it is generally agreed that a larger diameter ingot of acceptable quality can be produced by vacuum arc remelting as compared to electroslag remelting. Nonetheless, there are size limitations for vacuum arc remelting which, if exceeded, produce ingots with unacceptable levels of macrosegregation and microsegregation. Ingots from vacuum arc remelting may also contain inherent defects known as "white spots".

Cast ingot is processed via conventional mechanical working techniques to yield wrought stock with improved microstructures and properties. Such a combination of mechanical working may involve a combination of steps of forging, rolling and drawing to lead to a relatively smaller grain size. The thermomechanical processing of large ingots requires a large space on the factory floor and requires large and expensive equipment as well as large and costly energy input. In addition, the yield of final product may be low due to losses at each of the many steps involved.

For some alloys, metal producers manufacture powder prior to the metal working procedures in order to obtain the required microstructure and properties. In a common powder processing route, gas atomization is employed to produce metal powder which is subsequently screened. A selected portion of the screened powder is then encapsulated in a steel can and the can is hot isostatically pressed or extruded to consolidate the powder into a useful form. The consolidated billet may be processed by other conventional working steps to bring the consolidated product into final wrought form. Such processing of powder material is conventional and has been described in several publications.

An alternative to the previously described processing routes is to spray form the product in a process described in an number of U.S. patents, including U.S. Pat. Nos. 3,909,9231; 4,926,923; 4,779,802; 5,004,153; 5,310,165 as well as a number of other patents. The spray forming process is typically used to produce semi-finished product in the form of round billets, tubes or rings. In the spray forming process, a stream of molten metal or metal alloy is atomized with inert gas and the resulting spray is directed at a collector where the atomized droplets re-coalesce to form a high density product. The collector is rotated and simultaneously oscillated and may be moved away from the spray to maintain a constant spray distance. Rapid solidification of the droplets occurs during flight and on deposition thereby resulting in a fine, uniform microstructure without macrosegregation.

The potential advantages of spray forming processes have been described in the literature. In summary, spray forming produces a fine scale microstructure characteristic of rapid solidification in a single processing step from molten metal to product. T. Andersen, et al., in a paper given at the 1st European Conference on Continuous Casting in Florence, Italy, 1991, describes the commercial Osprey™ process. Leatham et al., in U.S. Pat. No. 4,938,275, describe certain important parameters in the Osprey process and discuss the importance of extracting heat from the atomized particles. Leatham describes a procedure whereby heat is extracted from the atomized particles by supplying gas to the atomizing device under carefully controlled conditions and by controlling the further extraction of heat after deposition.

Generally, the spray forming process has been gaining acceptance in industrial usage because of the excellent macrostructural and microstructural quality, and particularly because it involves fewer processing steps and has a cost advantage over conventional powder metallurgical techniques.

To achieve the best product quality, it has long been recognized that efforts must be taken to: 1) minimize porosity within the deposited metal; and 2) assure conditions of rapid solidification on the collector surface. Optimization of the spray process involves many factors, one of which is the temperature of the collector surface. If the collector surface is too cold, large amounts of undesirable porosity will result. On the other hand, if the surface is too hot, undesirable coarse or segregated structures may result.

One method of maintaining the temperature of the collector is to spray the next layer onto the collector as soon as the previous layer has cooled sufficiently to achieve structural integrity with the collector. Keutgen et al., U.S. Pat. No. 5,054,539, discloses an improvement in the process enabling the production of round bars of axial symmetry by spraying the molten metal onto a collector at such a rate that the collector is completely covered after a single 360° rotation of the collector. This requires cycle times, a cycle being the time between successive passes of the spray head over the same area of the collector, sufficiently short to prevent over-cooling of the previously deposited layer. A convenient method of accomplishing this objective is to rotate the collector at a sufficiently rapid speed to prevent overcooling.

Another technique of maintaining the temperature of the collector in the proper temperature range is to add or subtract heat from the system. Leatham et al. discuss the importance of extracting heat from the atomized particles. Ikawa, in U.S. Pat. No. 5,305,816, discusses the importance of adding heat to the system by adhering a molten metal to the collector prior to spraying the atomized metal onto the collector.

Other techniques have been proposed to increase or maintain adherence of the sprayed metal to the collector or mandrel. In U.S. Pat. No. 5,143,139, Leatham describes a method of spray forming which assures a strong bond between the surface of the collector and the spray droplets. Leatham proposes two techniques for assuring strong bonding between the sprayed metal and the collector surface. First, the collector surface is grit blasted before spray deposition. Leatham also proposes preheating the collector using a plasma heating means disposed immediately upstream of the deposition surface.

Cheskis et al. in U.S. Pat. No. 5,343,926, discloses using two nozzles to achieve a low porosity between the collector and the metal. The first nozzle directs an initial deposit onto the collector with a sufficient amount of molten metal to fill the inherent interstices between the splatted droplets while the mostly solid metal stream from the second nozzle has sufficient solids content to ensure that the shape is maintained.

One of the continuing limitations of the spray forming process is that the diameter of the spray formed preform is generally limited by physical constraints of the system. Utilizing conventional processing techniques, cylindrical preforms are limited to diameters of 12 inches or less and rings or tubular preforms are limited to about 36 inches maximum outer diameter. An increase in preform diameter will improve the economics of the process, make it even more competitive with consolidated powder and conventional processing, and open new markets for larger products.

One method of obtaining larger diameter ingots is disclosed by Forrest et al. in U.S. Pat. No. 5,472,038. Forrest discloses the use of multiple sprays for large diameter bars (e.g., 12 to 24 inches in diameter).

Other methods have been proposed to resolve the preform size problem. All of these methods are cumbersome and complex. The maximum preform sizes achieved using current technologies are about 12 inches in diameter for a single nozzle and about 20 inches in diameter for dual nozzle apparatus. There still exists a need to produce large size preforms easily and inexpensively.

The physical limitation which currently prevents spray forming of larger preforms is attributed to the need to deposit each spray formed particle onto the thin semi-liquid layer on the surface of the spray formed preform. Using present processing techniques, a spray formed preform is built up by directing the spray of molten metal onto the end or face of a rotating surface. As the spray deposit is built up, the preform is gradually withdrawn to maintain a constant distance from the spray nozzle to the surface of the preform. The preform can be oriented at any angle from the horizontal to vertical. To produce optimum quality spray formed product, particularly the highest density deposit, the operating conditions are set so that each particle will be deposited onto the semi-liquid layer which is maintained on the end surface of the preform.

To maintain this critical, semi-liquid layer as the preform diameter is increased, the rotational speed must increase so that complete solidification does not occur from the time a given segment exits the spray cone, is rotated approximately 360° and comes under the molten metal spray again. However, the rotational speed can only be increased a finite amount before the billet becomes unstable and breaks away from its mountings due to centrifugal forces. Also, if the speed is too great, centrifugal force causes the semi-liquid material on the surface to be flung off. Contrarily, if the speed is too slow, the semi-liquid material will solidify before a given segment re-enters the spray. The end result in either case is that the spray is deposited onto a solid layer. If the surface of the preform is not sufficiently liquid, the resulting billet will contain undesirable porosity.

OBJECTS OF THE INVENTION

The principal object of this invention is to provide means for processing larger spray formed preforms than are currently possible by eliminating the physical limitations that currently prevent this from occurring.

SUMMARY OF THE INVENTION

The invention comprises spraying a cone of atomized molten metal onto a rotating surface having a diameter greater than 10 inches and which surface is heated or reheated to the required temperature just prior to rotation into the molten metal spray cone. The invention also comprises using the same spraying technique to form a ring or tubular preform. This novel system permits the production of preforms having a diameter greater than 10 inches while utilizing only a single spray nozzle. We have accomplished this object by decoupling preform size from rotational speed to permit manufacture of larger diameter preforms.

The apparatus of the invention comprises a starter ingot (or collector) having a rotatable collection surface which has a diameter greater than 10 inches, means for holding and rotating the starter ingot and collection surface at a predetermined speed of rotation, a supply of molten metal or metal alloy communicating with a single spray nozzle, and including means for injecting the molten metal or metal alloy from the supply into the single spray nozzle for atomizing the molten metal or metal alloy; a source of heat, and means for applying heat from the source of heat to a predetermined portion of the collection surface; and means for directing the spray of atomized molten metal or metal alloy onto the heated portion of the collection surface.

BRIEF DESCRIPTION OF THE DRAWING

The foregoing and other objects will become more readily apparent by referring to the following detailed description and the appended drawings in which:

The two FIGURES illustrate diagrammatically the formation of a cylindrical billet and ring or tubular preform in accordance with the present invention.

DETAILED DESCRIPTION

Figure 1:
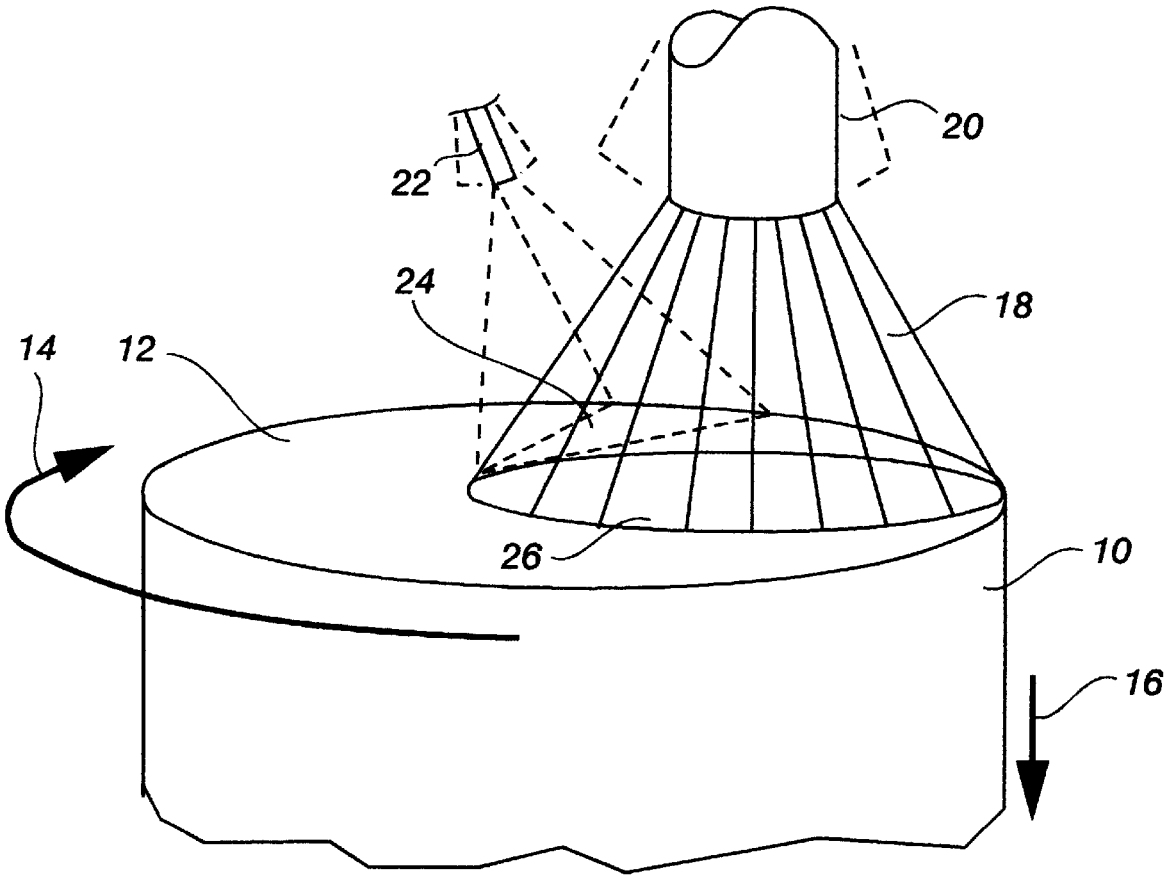

Referring now to FIG. 1, a metal or metal alloy billet or preform 10 having a collector surface 12 is rotated in direction 14 and withdrawn in direction 16 while being sprayed with atomized molten metal or metal alloy 18 produced in and projected by a spray nozzle 20. An auxiliary heating source 22 impinges upon the collector surface 12 to form a preheated zone 24.

A suitable molten metal stream is made available from the melting equipment. The molten metal is transformed into a suitable metal spray for spray forming by conventional means, preferably in the equipment described in U.S. Pat. No. 5,310,165, the disclosure of which is incorporated herein by reference and made a part hereof. The metal 18 is then sprayed onto a preform 10, or starter ingot, which is rotating. The limitation of preform size caused by the need to spray onto a semi-solid layer is overcome by providing a source of heat to zone 24 just prior to the impact area 26 of the spray 18. The heating source 22 is adjusted to impart sufficient energy to reheat the surface of zone 24 to a semi-solid state and thereby provide a suitable surface to receive the metal spray as the preform 10 rotates. Such an arrangement is shown schematically in FIG. 1.

In a preferred embodiment of the invention, the rate of application of the atomized metal is controlled such that the movement of the nozzle 20, the rotation of the substrate 10 and the quantity of molten metal 18 exiting the nozzle 20 are set to provide a layer of deposited metal of from about 0.01 inches to about 0.03 inches thick on each pass. Furthermore, the portion of surface 12 that is to receive the atomized metal is heated rapidly so as to create a thin layer of liquid to semi-solid metal on the collector surface. Generally this portion is heated to a temperature of from about 10 degrees F. to about 100 degrees F. below liquids for the metal being deposited, and preferably to a temperature of from about 20 degrees F. to about 75 degrees F. below liquidus.

Figure 2:
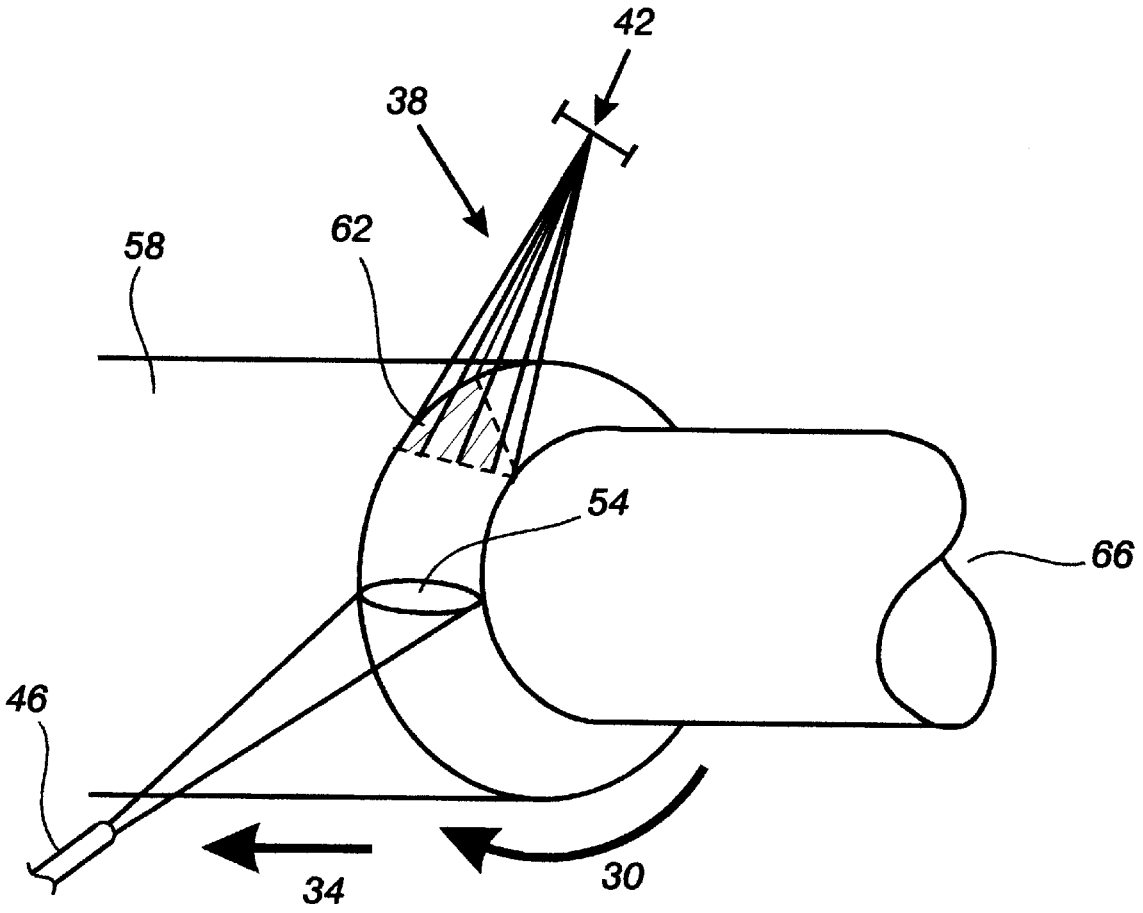

The invention may also be used to form rings or tubular preforms. Referring now to FIG. 2, a ring or tubular preform 58 situated about a mandrel 66 and having a collector surface 50 is rotated in direction 30 and withdrawn in direction 34 while being sprayed with atomized molten metal or metal alloy 38 produced in and projected by a spray nozzle 42. An auxiliary heating source 46 impinges upon the collector surface 50 to form a preheated zone 54.

A suitable molten metal stream is made available from the melting equipment. The molten metal is transformed into a suitable metal spray for spray forming by conventional means, preferably in the equipment described in U.S. Pat. No. 5,310,165, the disclosure of which is incorporated herein by reference and made a part hereof. The metal 38 is then sprayed onto a preform 58, a starter ring or tubular preform, which is rotating. The metal 38 is sprayed such that the preheated zone 54 is just prior to the area of contact 62 of the metal spray. The heating source 46 is adjusted to impart sufficient energy to reheat the surface of zone 54 to a semi-solid state and thereby provide a suitable surface to receive the metal spray 38 as the preform 58 rotates.

The invention completely eliminates the relationship between preform diameter and rotational speed normally required to produce high density spray-formed product. Such restrictions on the preform diameter no longer exist and the preform diameter is limitless up to the point where other physical system limitations are reached, such as the maximum allowable centrifugal force as discussed above.

The decoupling of the rotational speed from the temperature of the surface of the collector permits the equipment to operate at constant and reasonable rotational speed independent of preform size. By changing the rotational speed from a variable to a constant the system can be more finely tuned to the needs of the metal or alloy being spray deposited.

The benefits of the invented process are readily apparent when considering present process limitations for single nozzle spraying. If the diameter of the preform is less than ten inches, either current technology or the present invention can be utilized. If the diameter of the preform is from 10 inches to 14 inches, the current technology would provide only a limited capability and the resulting product would be of poor quality, while the present invention will perform well and provide high quality product. If the diameter of the preform is from 14 inches to 20 inches, the current technology could be utilized only if two nozzles were employed, but if the diameter of the preform exceeds 20 inches, the current technology cannot be used. On the other hand, the present invention will perform well and provide high quality product on all preform diameters from less than 10 inches to greater than 45 inches.

There are numerous variations that can be added to the basic applications as described above. For example, the nozzle may be fixed or movable. Preferably, the nozzle is movable and oscillates or swivels through a small angle, or it swings up and back on as long a path as required to cover the radius of the substrate of the ingot being produced.

The surface that is to receive the atomized metal is maintained at the desired temperature by the application of heat from the heat source located so as to apply heat to the area that is to receive atomized metal just prior to the moment of application of the atomized metal. The heat source may also be programmed to move in the same manner as the spray nozzle, such as to oscillate through a predetermined path or swivel.

In a second embodiment of the invention, the sprayed metal is applied to the substrate surface at a temperature below the desired temperature and heat is applied to the surface containing the just deposited metal to bring the surface up to the desired temperature. This procedure has the advantage of permitting metal flow into any interstitial voids that may have developed during the spraying of the metal onto the substrate.

In another embodiment of the invention, heat is applied to the substrate surface immediately prior to and immediately after deposition of sprayed metal. The benefit of this technique is to maintain the temperature of the surface at the desired temperature for an extended period of time, thus permitting an opportunity for the atomized metal to fill any interstitial spaces. This also permits a lower temperature to be used since the surface remains at above the minimum desired temperature for a longer period of time.

In a preferred embodiment of our invention, the heat source or sources are arranged so they oscillate in coordination with the oscillation of the spray nozzle. The coordination of movement of the heat source with the movement of the nozzle minimizes the area of the substrate surface to be heated.

With regard to the area of the collector surface to be heated, we prefer to heat the minimum surface area necessary to maintain the temperature of the collector surface at the desired temperature when the sprayed metal impinges on the surface. It will be recognized by those skilled in the art that this area will vary in size depending on whether or not an oscillating heat source is used, the rotational speed of the collector, the intensity of the heat source and other parameters dependent upon the precise configuration of the spray apparatus.

It is preferable to heat the area directly upstream from the area to be sprayed.

The source of heat may be any conventional heat source such as a laser, high temperature flame, plasma arc, electric induction, or radiation heat source. It is preferred to utilize a plasma or laser. As noted earlier, the heating source is controlled to impinge upon the surface just prior to and adjacent to the area of the spray. It is also controlled to locally heat the previously described collector area to a temperature which provides a thin, molten or semi-solid layer on the surface. The layer is then suitable for depositing the incoming metal spray without the formation of deleterious porosity, while at the same time allowing rapid solidification of the deposited metal.

SUMMARY OF THE ACHIEVEMENT OF THE OBJECTS OF THE INVENTION

From the foregoing, it is readily apparent that we have invented an improved method and apparatus for processing larger spray formed preforms than are currently possible by eliminating the physical limitations that currently prevent this from occurring. We have decoupled preform size from rotational speed to permit manufacture of larger diameter preforms.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A process of spray forming a generally cylindrical metal or metal alloy billet, ring, or tubular form having a diameter greater than 10 inches, comprising:

a) providing a supply of molten metal or metal alloy;

b) rotating a collection surface having an outer diameter greater than 10 inches;

c) providing a source of heat;

d) injecting the molten metal or metal alloy into a single spray nozzle, thereby atomizing the molten metal or metal alloy;

e) applying heat to a portion of the collection surface; and f) depositing the atomized molten metal or metal alloy by spraying it onto the heated portion of the collection surface.

2. The process of claim 1 wherein the outer diameter of the collection surface is at least 14 inches.

3. The process of claim 1 wherein the heated portion of the collection surface is heated to a temperature in the range of from about 10° F. to about 100° F. below the liquidus temperature.

4. The process of claim 3 wherein the heated portion of the collection surface is heated to a temperature in the range of from about 20° F. to about 75° F. below the liquidus temperature.

5. The process of claim 1 wherein the heat source is selected from the group consisting of laser, high temperature flame, plasma arc, electric induction, and radiation heating sources.

6. The process of claim 5 wherein the heat source is a plasma arc.

7. The process of claim 5 wherein the heat source is a laser.

8. The process of claim 1 wherein heat is applied to the portion of the collection surface immediately after depositing atomized metal or metal alloy, on that portion, thereby minimizing porosity.

9. The process of claim 1 wherein heat is applied to the portion of the collection surface both immediately prior and immediately after deposition of atomized metal or metal alloy.

10. The process of claim 1 wherein the collection surface is rotated at a preselected speed of rotation.

11. The process of claim 1 wherein the spray nozzle is oscillated during metal deposition.

12. The process of claim 1 wherein the heat source oscillates.

13. The process of claim 11 wherein the heat source oscillates in conjunction with the spray nozzle.

14. A process of spray forming a metal or metal alloy billet, ring, or tubular form having an outer diameter greater than 10 inches comprising:

a) providing a supply of molten metal or metal alloy;

b) providing a rotating collection surface having an outer diameter greater than 10 inches;

c) providing a source of heat;

d) injecting the molten metal or metal alloy into a single spray nozzle, thereby atomizing the molten metal or metal alloy;

e) spraying the atomized molten metal or metal alloy onto a preselected portion of the collection surface; and f) applying heat to said portion of the collection surface immediately following spraying of said portion with molten metal or metal alloy.

* * * * *